United States Patent [19]

Hiraga et al.

[11] Patent Number: 4,468,178

[45] Date of Patent: Aug. 28, 1984

[54] SCROLL TYPE COMPRESSOR WITH DISPLACEMENT ADJUSTING MECHANISM

[75] Inventors: Masaharu Hiraga, Honjo; Atsushi Mabe, Isesaki; Yuji Yoshii, Takasaki, all of Japan

[73] Assignee: Sanden Corporation, Gunma, Japan

[21] Appl. No.: 356,648

[22] Filed: Mar. 9, 1982

[30] Foreign Application Priority Data

Mar. 9, 1981 [JP] Japan ..... 56-33646

[51] Int. Cl.[3] ..... F04B 49/02; F04C 18/02; F04C 29/10

[52] U.S. Cl. ..... 417/440; 418/55; 137/870; 251/141

[58] Field of Search ..... 418/55; 417/304, 440; 137/870; 251/141

[56] References Cited

U.S. PATENT DOCUMENTS

| | | | |
|---|---|---|---|
| 1,859,879 | 5/1932 | Longacre | 251/141 |
| 3,386,472 | 6/1968 | Szonntagh | 251/141 |
| 3,751,001 | 8/1973 | Rayment | 251/141 |
| 4,192,152 | 3/1980 | Armstrong et al. | 62/402 |
| 4,216,661 | 8/1980 | Tojo et al. | 62/505 |
| 4,357,132 | 11/1982 | Kousokabe | 418/55 |
| 4,383,805 | 5/1983 | Teegarden et al. | 418/55 |

FOREIGN PATENT DOCUMENTS 2195270 2/1974 France .

*Primary Examiner*—John J. Vrablik

*Attorney, Agent, or Firm*—Banner, Birch, McKie & Beckett

[57] ABSTRACT

A scroll type compressor is disclosed. The compressor includes a housing. A fixed scroll is joined to the housing and includes a first end plate from which a first wrap extends. An orbiting scroll also includes second end plate from which a second wrap extends. The wraps interfit at an angular and radial offset to make a plurality of line contacts to define at least one pair of sealed off fluid pockets. The first end plate is formed with at least two holes which are placed at the symmetrical positions. A first of the holes is placed at a location, defined by involute angles, within the area defined by $\phi$ end $>\phi 1>\phi$ end-$2\pi$, where $\phi$ end is the final involute angle of the wrap which extends from the end plate having the holes, and $\phi$ 1 is the involute angle at which the first hole is placed. The second hole is located at an involute angle approximately $\phi 1$-$\pi$. A control mechanism controls the opening and closing of the holes to thereby control the capacity of compressor.

7 Claims, 10 Drawing Figures

FIG. 2
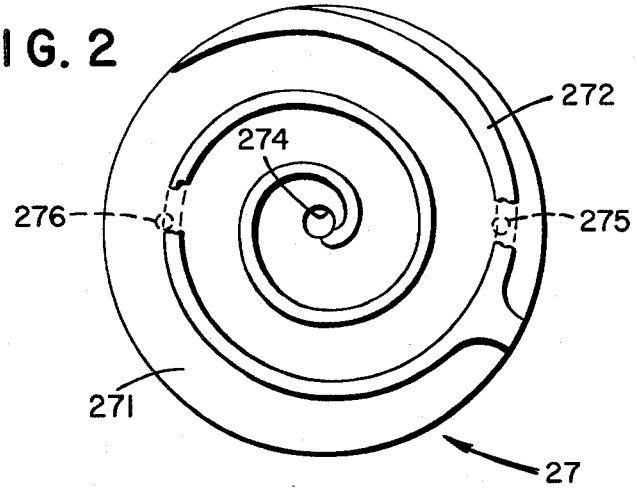
FIG. 3
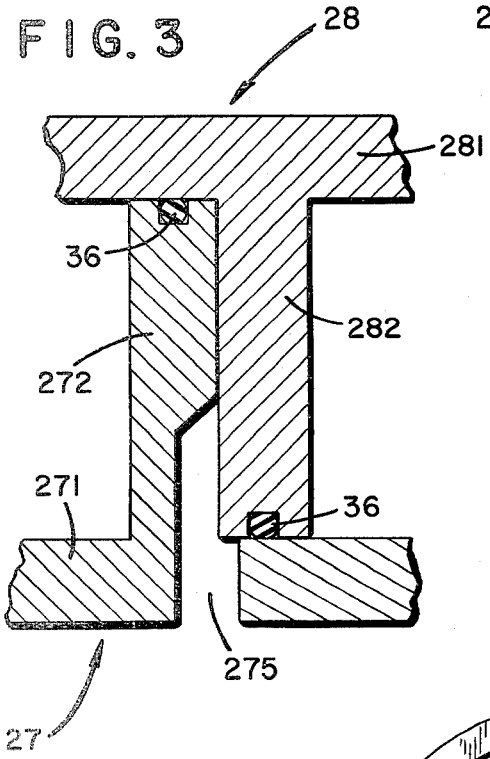
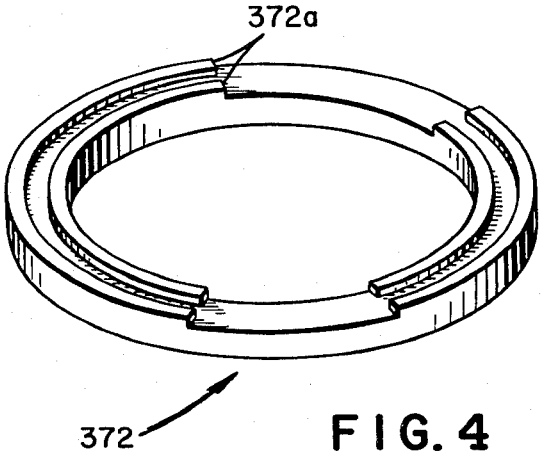
FIG. 4
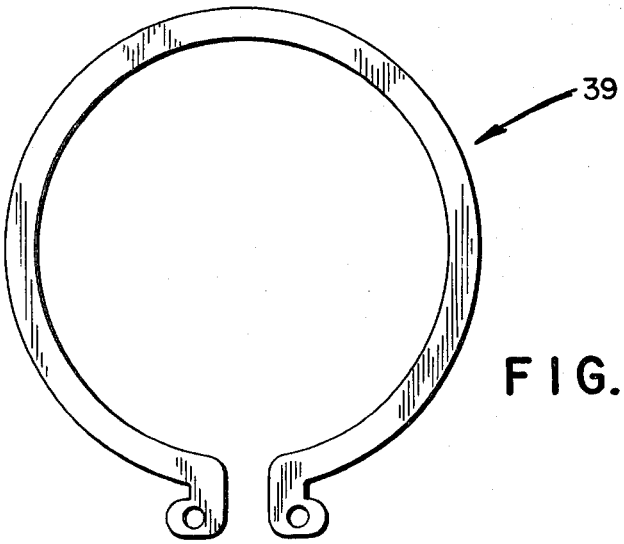
FIG. 5

SCROLL TYPE COMPRESSOR WITH DISPLACEMENT ADJUSTING MECHANISM

BACKGROUND OF THE INVENTION

This invention relates to a compressor, and more particularly, to a scroll type compressor for an air conditioning apparatus which includes a mechanism for adjusting the displacement of the compressor.

Scroll type fluid displacement apparatus are well known in the prior art. For example, U.S. Pat. No. 801,182 (Creux) discloses a device including two scrolls each having a circular end plate and a spiroidal or involute spiral element. These scrolls are maintained angularly and radially offset so that both spiral elements interfit to make a plurality of line contacts between their spiral curved surfaces to thereby seal off and define at least one pair of fluid pockets. The relative orbital motion of the two scrolls shifts the line contact along the spiral curved surfaces and, as a result, the volume of the fluid pockets changes. Since the volume of the fluid pockets increases or decreases dependent on the direction of the orbital motion, the scroll type fluid apparatus is applicable to compress, expand or pump fluids.

Scroll type fluid displacement apparatus are suitable for use as refrigerant compressors in air conditioners. In such air conditioners, thermal control in the room or control of air conditioner is generally accomplished by intermittent operation of the compressor which in turn is activated or controlled by a signal from a thermostat located in the room being cooled. Once the temperature in the room has been cooled down to a desired temperature, the refrigerant capacity of the air conditioner for supplemental cooling because of further temperature changes in the room, or for keeping the room at the desired temperature, generally need not be very large. However, prior art air conditioners do not have capacity control mechanisms. Therefore, after the room has been cooled to the desired temperature, the manner for controlling the output of the compressor is by intermittent operation of the compressor. The relatively large load, which is required to drive the compressor, is thus intermittently applied to the driving source. When the compressor is used in an automotive air conditioner, it is driven by the engine of automobile through a electromagnetic clutch. Such prior art automotive air conditioners face the same output problem once the passenger compartment reaches a desired temperature. Control of the compressor's output is accomplished by intermittent operation of the compressor through a magnetic clutch which connects the automobile engine to the compressor. The relatively large load, which is required to drive the compressor, is thus intermittently applied to the automobile engine.

SUMMARY OF THE INVENTION

It is a primary object of this invention to provide an improvement in a scroll type compressor by incorporating a mechanism for changing the compression ratio of the compressor as occasion demands without the loss of energy consumption.

It is another object of this invention to provide a scroll type compressor in which sealing of the fluid pockets is maintained while achieving the above object.

It is a further object of this invention to provide a scroll type compressor which is simple in construction and can be simply and reliably manufactured.

A scroll type compressor according to this invention includes a pair of scrolls. Each scroll includes an end plate and a wrap extending from one side surface of the end plate. The wraps interfit at an angular and radial offset to make a plurality of line contacts and define at least one pair of sealed off fluid pockets. One of the scrolls (an orbiting scroll) is driven in orbital motion by the rotation of a drive shaft, while the rotation of the orbiting scroll is prevented. The fluid pockets shift along the spiral curved surface of the wrap to change the volume of the fluid pockets. One of the end plates has at least a pair of holes formed through it. The holes are placed in symmetrical positions so that the wrap of the other scroll member simultaneously crosses over the holes. A first of the holes is placed within an area defined by $\phi\text{end} > \phi 1 > \phi\text{end}-2\pi$, where $\phi$end is the final involute angle of the wrap which extends from the end plate having the holes, and $\phi 1$ is the involute angle at which the hols is located. A control device controls the opening and closing of the holes. The displacement volume of the fluid pockets is controlled by opening and closing the holes with the control device. When the holes are closed compression operates normally and the displacement volume is not changed. When the holes are opened by the control device, fluid in the sealed off pockets flows back into the suction chamber through the holes until the spiral element of the other scroll crosses over the holes. The displacement volume in the fluid pockets is thereby reduced, and compression starts at an intermediate stage.

Further objects, features and other aspects of this invention will be understood from the detailed description of preferred embodiments of this invention with reference to the annexed drawings.

BRIEF DESCRIPTION OF THE DRAWINGS

FIG. 2 is a front end view of the fixed scroll member used in the compressor of FIG. 1;

FIG. 3 is a sectional view of the spiral elements illustrating the hole extending into one of the spiral elements;

FIG. 4 is a perspective view of a magnetic coil used in the compressor of FIG. 1;

FIG. 5 is a front end view of a snap ring used in the compressor of FIG. 1;

DETAILED DESCRIPTION OF THE INVENTION

Figure 1:
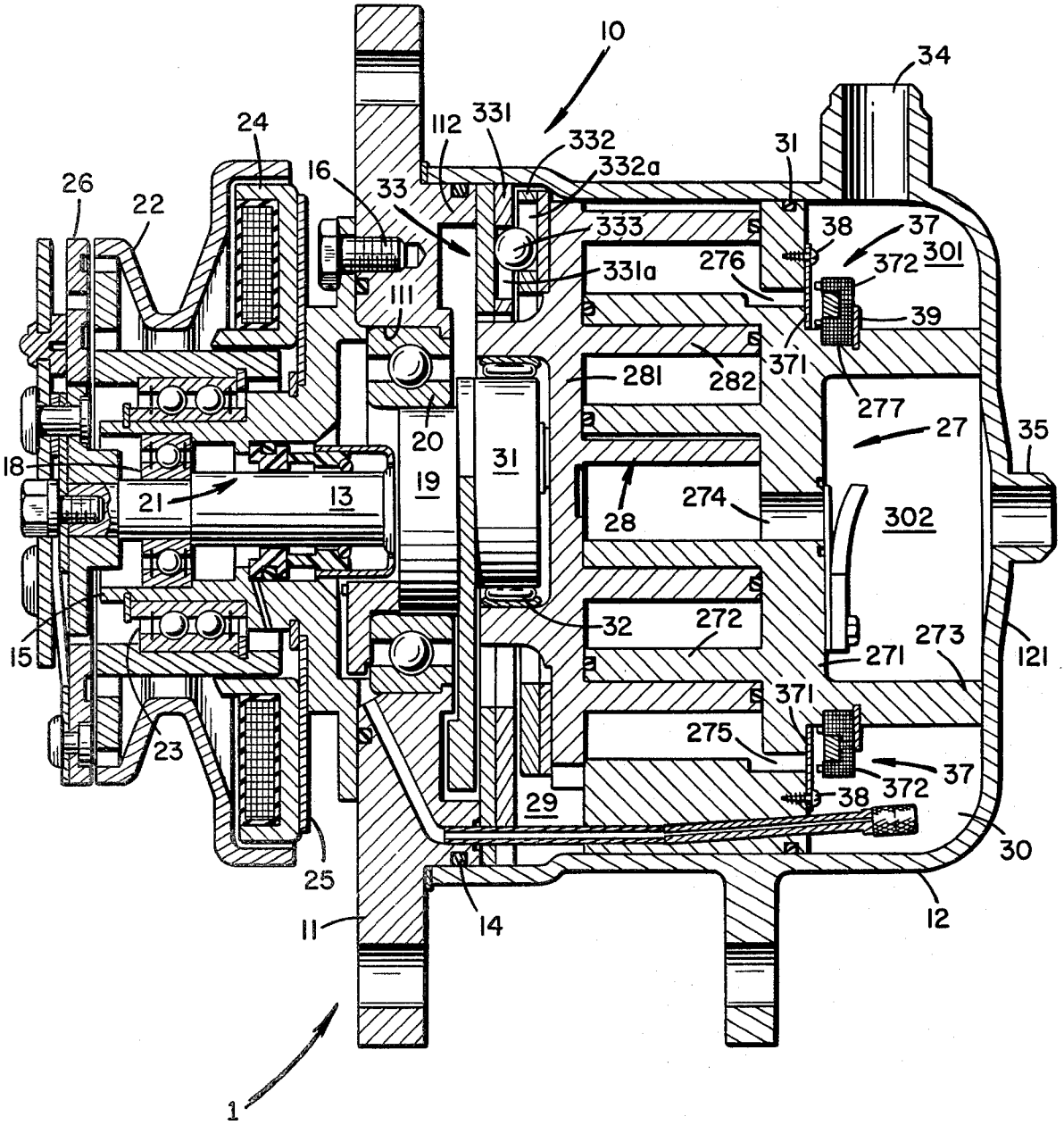
FIG. 1 is a vertical sectional view of a scroll type compressor unit according to an embodiment of this invention.

Referring to FIG. 1, a refrigerant compressor in accordance with an embodiment of the present invention, in particular, a scroll type refrigerant compressor 1 is shown. The compressor 1 includes a compressor housing 10 having a front end plate 11 and a cap shaped casing 12 which is attached to an end surface of front end plate 11.

An opening 111 is formed in the center of front end plate 11 for the penetration or passage of a drive shaft 13. An annular projection 112 is formed in a rear end surface of front end plate member 11. Annular projection 112 faces cup shaped casing 12 and is concentric with opening 111. An outer peripheral surface of annular projection 112 extends into an inner wall of the opening of cup shaped casing 12. Cup shaped casing 12 is fixed on the rear end surface of front end plate 11 by a fastening device for example, bolts and nuts. The opening of cup shaped casing 12 is thus covered by front end plate 11. An O-ring 14 is placed between the outer peripheral surface of annular projection 112 and the inner wall of the opening of cup shaped casing 12 to seal the mating surfaces of front end plate 11 and cup shaped casing 12.

Front end plate 11 has an annular sleeve 15 projecting from the front end surface thereof which surrounds drive shaft 13 and defines a shaft seal cavity. In the embodiment shown in FIG. 1, sleeve 15 is separate from end plate member 11. Therefore, sleeve 15 is fixed to the front end surface of front end plate 11 by screws 16. An O-ring is placed between the end surface of front end plate 11 and the end surface of sleeve 15 to seal the mating surfaces of front end plate 11 and sleeve 15. Alternatively, sleeve 15 may be integral with front end plate 11.

Drive shaft 13 is rotatably supported by sleeve 15 through a bearing 18 located within the front end of sleeve 15. Drive shaft 13 has a disk 19 at its inner end which is rotatably supported by front end plate member 11 through a bearing 20 located within opening 111 of front end plate 11. A shaft seal assembly 21 is coupled to drive shaft 13 within the shaft seal cavity of sleeve 15.

A pulley 22 is rotatably supported by a bearing assembly 23 which is carried on the outer surface of sleeve 15. An electromagnetic coil 24 is fixed about the outer surface of sleeve 15 by a support plate 25 and is received in an annular cavity of pulley 22. An armature plate 26 is elastically supported on the outer end of drive shaft 13 which extends from sleeve 15. A magnetic clutch thus includes pulley 22 magnetic coil 24, and armature plate 26. In operation, drive shaft is driven by an external power source, for example the engine of an automobile, through a rotation transmitting device such as the magnetic clutch.

A fixed scroll 27, an orbiting scroll 28, a driving mechanism of orbiting scroll 28, and a rotation preventing mechanism for orbiting scroll 28 are located in an inner chamber of cup shaped casing 12.

Fixed scroll 27 includes a circular end plate 271, a wrap or spiral element 272 affixed to or extending from one side surface of end plate 271. A partition wall 273 axially projects from the opposite side surface of circular end plate 271. An axial end surface of partition wall 273 is seated against and connected to an inner surface of end plate portion 121 of cup shaped casing 12 by fasteners (not shown). Circular end plate 271 of fixed scroll member 27 partitions the inner chamber of cup shaped casing 12 into a first chamber 29 and a second chamber 30. A seal ring 31 is placed between the outer peripheral surface of end plate 271 and the inner wall of cup shaped casing 12 to form a seal between the mating surfaces. Spiral element 272 of fixed scroll member 27 is located within first chamber 29 and partition wall 273 is located within second chamber 30. Partition wall 273 further divides second chamber 30 into a suction chamber 301 and a discharge chamber 302.

Orbiting scroll 28 is located in first chamber 29 and also includes a circular end plate 281 and a wrap or spiral element 282 affixed to or extending from one side surface of end plate 281. Spiral elements 272 and 282 interfit at an angular offset of 180° and a predetermined radial offset. At least a pair of sealed off fluid pockets are thereby defined between the spiral elements 272 and 282.

Orbiting scroll 28 is rotatably supported by a bushing 31 through a bearing placed on the outer peripheral surface of bushing 31. Bushing 31 is connected to an inner end of disk 19 at a point radially offset or eccentric of the axis of drive shaft 13.

A rotation preventing/thrust bearing device 33 is placed between the inner end surface of front end plate 11 and the end surface of end plate 281 which faces the inner end surface of front end plate 11. Rotation preventing/thrust bearing device 33 includes a fixed ring 331 attached to the inner end surface of front end plate member 11, an orbiting ring 332 attached to the end surface of end plate 281, and a plurality of bearing elements, such as balls 333 placed between pockets **331*a*, 332*a* through rings 331 and 332. The rotation of orbiting scroll 28 during its orbital motion is prevented by the interaction of balls 333 with rings 331, 332; and the axial thrust load from orbiting scroll 28 is supported on front end plate 11 through balls 333**.

Cup shaped casing 12 has an inlet port 34 and outlet port 35 for connecting the compressor unit with an external fluid circuit. Fluid is introduced from the external circuit into suction chamber 301 through inlet port 34 and flows into chamber 29 through a connecting hole formed through end plate 271 at a position near its outer peripheral surface. The fluid in chamber 29 is taken into the fluid pockets formed between spiral element 272 and 282. As orbiting scroll 28 orbits, the fluid in the fluid pockets moves to the center of spiral elements and is compressed. The compressed fluid is discharged into discharge chamber 302 from the fluid pockets in the general area of the center of the spiral elements through a hole 274 formed through circular end plate 271. The compressed fluid is then discharged to the external fluid circuit through outlet port 35.

In such operation, fluid is generally taken into the fluid pockets formed between spiral element 272 and 282 through two open spaces. Each open space is defined between the outer terminal end of one of the spiral elements and the outer wall surface of the other spiral element. The entrance to these open spaces sequentially open and close during the orbital motion of orbiting scroll 28. While the entrances to these open spaces remain open, fluid to be compressed flows into them, but no compression occurs. After the entrances to the open spaces close, the sealed off fluid pockets are formed, no additional fluid flows into the pockets, and compression begins. The location of the outer terminal end of each spiral element 272 and 282 is at the final involute angle, therefore, the location of these open spaces is directly related to the final involute angle.

Referring to FIG. 2, the final involute angle ($\phi$ end) at the end of spiral element 272 of fixed scroll member 27 greater than $4\pi$ but less than $5\pi$. At least one pair of holes 275 and 276 are formed in end plate 272 of fixed scroll 27 and are placed at symmetrical positions so that an axial end surface of spiral element 282 of orbiting scroll member 28 simultaneously crosses over holes 275 and 276. Hole 275 communicates between suction chamber 301 and one of the fluid pockets A, and hole 276 communicates between suction chamber 301 and the other fluid pocket A'.

Hole 275 is placed at a position defined by the involute angle $\phi 1$ and opens along the inner wall side of spiral element 272. Thus, $\phi 1$ is the involute angle location of the first hole, which is nearest the final involute angle ($\phi$ end) at the end of spiral element 272. The other hole 276 is placed at a position defined by the involute angle ($\phi 1$-$\pi$) and opens along the outer wall side of spiral element 272. The preferred area within which to place the first hole 275, as defined in involute angles, is given by $\phi$ end $>\phi 1>\phi$ end-$2\pi$. The other hole 276 is located further from $\phi$ end, i.e., at $\phi 1$-$\pi$.

Holes 275 and 276 are formed by drilling into end plate 271 from the side opposite from which spiral element 272 extends. Hole 275 is drilled at a position which overlaps with the inner wall of spiral element 272, so that portion of the inner wall of spiral element 272 is removed. Hole 276 is drilled at a position which overlaps the outer wall of spiral element 272 so that a portion of the outer wall of spiral element 272 is removed. This overlapping of hole 275 is shown in detail in FIG. 3. In this arrangement, the axial end surface of each spiral element is provided with a seal which forms an axial seal between the spiral element and facing end plate. Holes 275 and 276 are positioned so that they do not connect with the fluid pockets between the spiral elements when spiral element 282 completely overlaps the holes. This is accomplished by extending a portion of each hole into spiral element 272 with the result that seal element 36 in spiral element 282 remains completely in contact with end plate 271 when spiral element 282 completely overlaps the holes, while the size of holes 275 and 276 are kept sufficiently large.

A control mechanism 37 is located in suction chamber 301 and connected to the outer peripheral surface of partition wall 273. Control mechanism 37 includes a value member having a plurality of valve plates 371 which are attached to the end surface of end plate 271 at each hole 275 and 276, and an annular shaped electromagnetic coil 372 attached to the outer surface of partition wall 273.

Each valve plate 371 is made of a spring type magnetic material, and is attached to the end surface of end plate 271 by a fastener, such as a screw 38. Magnetic coil 37 is fitted into a groove 277 formed on the outer peripheral surface of partition wall 273, and is held therein against axial movement by a snap ring 39, as shown in FIG. 5. The inherent spring tendency of each valve plate 371 pushes it against the opening of a respective hole 275, 276 to thus close the opening of each hole. Valve plates 371 are controlled by the operation of magnetic coil 372. By activating coil 372 the valve plates 371 are bent away from the openings in holes 275 and 276. Deactivating coil 372 permits the valve plates to again seal the openings to the holes because of their inherent spring tendency.

Magnetic coil 372 is provided with contact portions 372*a* at its end surface facing the valve plates 371. When valve plates 371 are drawn away from holes 275 and 276 by magnetic coil 372, they contact portions 372*a*.

Figure 6:
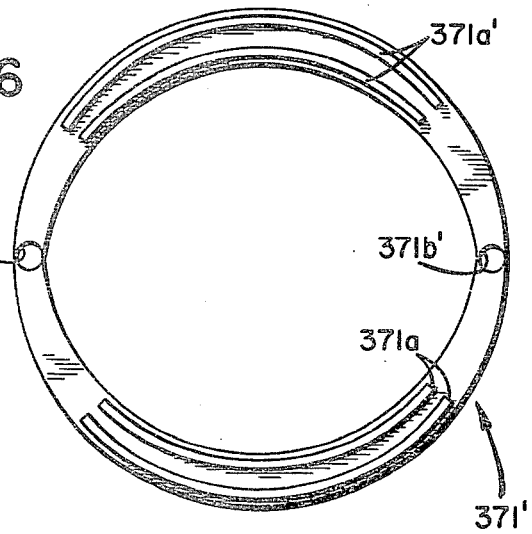
FIG. 6 is a front end view of a valve mechanism according to another embodiment of this invention.
Figure 7:
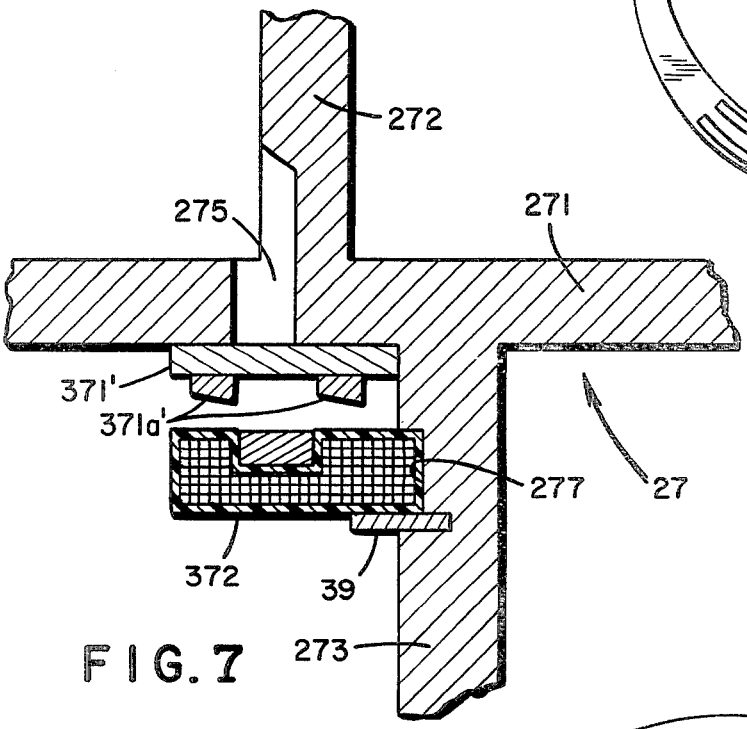
FIG. 7 is a sectional view of a control mechanism according to another embodiment of this invention.

FIGS. 6 and 7 illustrate another embodiment of the valve member. In this embodiment, the valve member is formed as an annular valve plate 371' which has an inherent spring property or tendency. Contact portions 371*a'* extend from the end surface of plate 371' opposite to magnetic coil 372 and serve as contact points with coil 372. Valve plate 371' is fixed on the end surface of end plate 271 by two screws (not shown) which pass through holes 371*b'* in valve plate 371'. Valve plate 371' is held in sealing contact against the openings of holes 275 and 276 by its inherent spring property. However, when coil 372 is energized, valve plate 371' bends against its inherent spring property and holes 275 and 276 open.

Referring to FIG. 8, the operation of the mechanism for changing the displacement volume of the fluid pockets, i.e., the volume of the sealed off fluid pockets at the time compression begins, will be described.

Figure 8A:
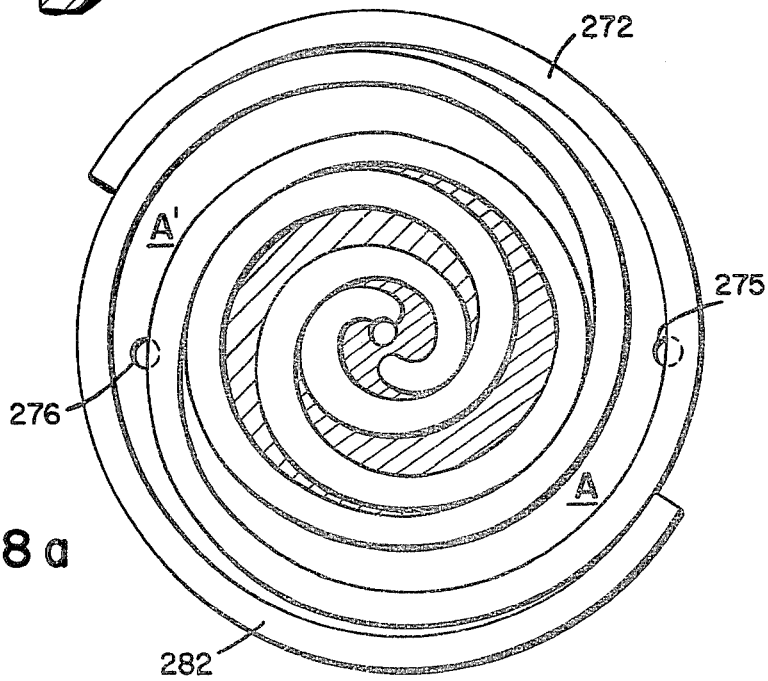
FIGS. 8*a*-8*c* are schematic views illustrating the operation of volume changing mechanism utilizing a pair of holes.
Figure 8B:
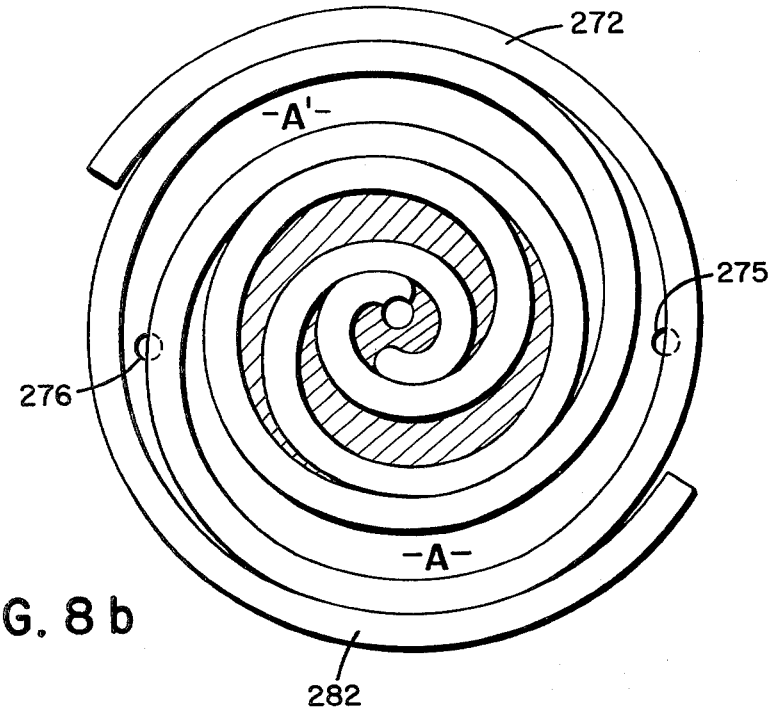
Figure 8C:
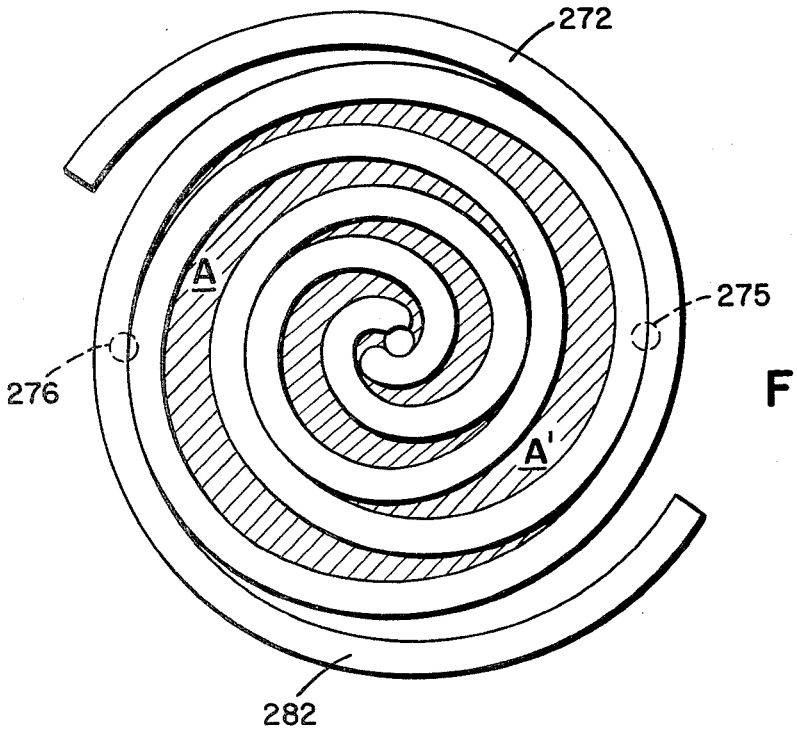

When, during orbital motion, the terminal end portion of both spiral elements 272, 282 are in contact with the opposite side wall of the other spiral element a pair of fluid pockets A, A' are sealed off and simultaneously formed at symmetrical locations as shown in FIG. 8*a*. If holes 275 and 276 are closed by valve member 371, compression of the fluid taken into the fluid pockets through the open space between the spiral elements begins. The fluid in the fluid pockets moves to the center of spiral element with the resultant volume reduction and compression, and is discharged into discharge chamber 302 through hole 274. In this operative mode, compression operates normally and the displacement volume of sealed off fluid pockets is determined when the terminal ends of the spiral elements first contact the other spiral element.

When valve member 371 is attracted to magnetic coil 372 by its activation, each hole 275 and 276 is opened. Thus, even though sealed off fluid pockets have been formed by contact of the terminal ends of the spiral elements with the opposite spiral elements, fluid which has been taken into the sealed off fluid pockets leaks from the sealed off fluid pockets A, A' back to suction chamber 301 during the orbital motion of orbiting scroll 28 from the position shown in FIG. 8*a* to the position shown in FIG. 8*b*. During this leaking or back flow, compression can not begin. This leaking continues until the axial end surface of spiral element 282 of orbiting scroll 28 crosses over and closes holes 275 and 276, this state being shown in FIG. 8*c*. As a result, the actual compression stroke of fluid pockets A, A' starts after the spiral element 282 of orbiting scroll 28 crosses over two holes 275, 276. The volume of the fluid pockets A, A' at the time when the pockets are sealed from the suction chamber 301 and compression actually begins, is thereby reduced. In this manner, the capacity of the compressor is reduced.

In the preferred embodiment, the involute angle location of first hole 275 is given by $\phi 1>\phi$ end-$2\pi$. The closer $\phi 1$ is placed to $\phi$ end-$2\pi$, the larger the reduction of the displacement volume, and conversely, the closer $\phi 1$ is made to $\phi$ end, the smaller the reduction in the displacement volume. If the reduction in displacement volume is made too small, excess compression capacity would remain for conditions where only small temperature differentials are to be adjusted by the air conditioning system.

This invention has been described in detail in connection with preferred embodiments but these embodiments are merely for example only and this invention is not restricted thereto. It will be easily understood by those skilled in the art that other variations and modifications can be easily made within the scope of this invention, as defined by the appended claims.

We claim:

1. In a scroll type compressor including a pair of scrolls each having an end plate and a wrap extending from one side surface of said end plate, said wraps interfitting at angular and radial offset to make a plurality of line contacts between said wraps to define at least one pair of sealed off fluid pockets, and a driving mechanism operatively connected to one of said scrolls for orbiting said one scroll relative to the other scroll while preventing rotation of said one scroll to thereby change the volume of the fluid pockets, one of said end plates having at least one pair of holes through it to interconnect a lower pressure space with fluid pockets which are newly formed at an outer portion of said scrolls, said holes being located at symmetrical locations along the wrap which extends from the last-mentioned end plate so that said other wrap simultaneously crosses over both of said holes to simultaneously block communication through both of said holes, a first of said holes opening along the inner wall of the wrap which extends from the last-mentioned end plate and being located within an area defined by $\phi$ end $>\phi 1>\phi$ end-$2\pi$, where $\phi$ end is the final involute angle of the wrap extending from the end plate through which said holes are formed and $\phi 1$ is the involute angle at which said first hole is located, the other of said holes opening along the outer wall of the wrap which extends from the last-mentioned end plate and being located at an involute angle of approximately $\phi 1$-$\pi$, and control means for selectively opening and closing said holes to permit fluid communication therethrough and to selectively control the displacement volume of said compressor.

2. The scroll type compressor of claim 1 wherein said control means includes a valve member and an electromagnetic coil actuator, said valve member being attached to the end surface of said end plate and covering the opening of each of said holes, said electromagnetic coil being supported adjacent said valve member to selectively control the movement of said valve member.

3. The scroll type compressor of claim 2 wherein said valve member comprises a separate flat plate attached adjacent each of said holes.

4. The scroll type compressor of claim 2 wherein said valve member comprises an annular plate.

5. The scroll type compressor of claim 1, 2, 3 or 4 wherein the first of said holes extends into the inner wall of said last-mentioned wrap, and the second of said holes extends into the outer wall of said last-mentioned wrap.

6. A scroll type compressor comprising;

a housing have a fluid inlet port and a fluid outlet port;

a fixed scroll joined to said housing and having a first end plate from which a first wrap extends into said housing;

an orbiting scroll having end plate from which a second wrap extends, said first and second wraps interfitting at an angular and radial offset to make a plurality of line contacts to define at least one pair of sealed off fluid pockets;

a driving mechanism including a rotatable drive shaft to drive said orbiting scroll in orbital motion by the rotation of said drive shaft to thereby change the volume of the fluid pockets;

one of said end plates having at least one pair of holes through it to interconnect a lower pressure space in said housing with fluid pockets which are newly formed at an outer portion of said scrolls, said holes being located at symmetrical locations along the wrap which extends from the last-mentioned end plate so that said other wrap simultaneously crosses over both of said holes, a first of said holes opening along the inner wall of the wrap which extends from the last-mentioned end plate and being located within an area defined by $\phi$ end$>\phi 1>\phi$ end-$2\pi$, where $\phi$ end is the final involute angle of the wrap extending from the end plate through which said holes are formed and $\phi$ I is the involute angle at which said first hole is located, the other of said holes opening along the outer wall of the wrap which extends from the last-mentioned end plate and being located at an involute angle of approximately $\phi 1$-$\pi$; and control means for selectively opening and closing said holes to selectively control the displacement volume of said compressor.

7. A scroll type compressor comprising:

a housing having a front end plate and a cup-shaped casing;

a fixed scroll fixedly disposed within said cup-shaped casing and having a first end plate from which a first wrap extends and an annular partition wall projecting from the side surface of said first end plate opposite the surface from which said first wrap extends;

an orbiting scroll having end plate from which a second wrap extends, said first and second wraps interfitting at an angular and radial offset to make a plurality of line contacts to define at least one pair of sealed off fluid pockets;

said first end plate partitions the interior of said cup-shaped casing into first and second chambers and said partition wall divides said second chamber into a suction chamber and discharge chamber;

at least one pair of holes being formed through said first end plate to interconnect the suction chamber with fluid pockets which are newly formed at the outer portion of said scrolls, said holes being located at symmetrical locations along said first wrap so that said second wrap simultaneously cross over both of said holes, a first of said holes opening along the inner wall of said first wrap and being located within an area defined by $\phi$ end$>\phi 1>$-$\phi$ end-$2\pi$, where $\phi$ end is the final involute angle of said first wrap and $\phi$ 1 is the involute angle at which said first of said holes is located, the other of said holes opening along the outer wall side of said first wrap and being located at an involute angle of approximately $\phi 1$-$\pi$; and control means disposed in the suction chamber and including a valve member attached on said first end plate to close said holes and an electromagnetic coil disposed on said partition wall to selectively control the movement of said valve member.

* * * * *